United States Patent [19]

Thompson

[11] 4,189,128

[45] Feb. 19, 1980

[54] MANUAL LIFTER AND MOVER ASSEMBLY

[75] Inventor: Larry J. Thompson, Pembroke Pines, Fla.

[73] Assignee: Equipment Company of America, Hialeah, Fla.

[21] Appl. No.: 936,283

[22] Filed: Aug. 23, 1978

[51] Int. Cl.[2] ..... B66F 3/08

[52] U.S. Cl. ..... 254/7 R

[58] Field of Search ..... 254/7 R, 7 B, 7 C, 2 R, 254/2 B, 2 C, 103; 280/47.27

[56] References Cited

U.S. PATENT DOCUMENTS 2,548,806 4/1951 Montour ..... 254/2 R

FOREIGN PATENT DOCUMENTS 452080 11/1927 Fed. Rep. of Germany ..... 254/7 R

*Primary Examiner*—Robert C. Watson

*Attorney, Agent, or Firm*—Cullen, Sloman, Cantor, Grauer, Scott & Rutherford

[57] ABSTRACT

The manual lifter and mover assembly or dolly includes a base and a vertically movable carriage mounted on the base. The base is provided with a pair of wheels and includes a pair of parallel channel members of equal length forming tracks which face the carriage. The carriage has a pair of outer vertical elements and an intermediate vertical element. A lift plate or fork-like element is carried by the lower end of the carriage for engaging and supporting the load. A pair of roller assemblies are carried by each of the outer vertical elements, with the roller assemblies extending into the opposite tracks of the channel members. A manually operated nut and screw jack assembly is interposed between the base and the carriage, with the jack assembly having a pair of telescopically arranged inner and outer tubes. The lower end of the inner tube is secured to the base while the outer tube is secured to the intermediate vertical element of the carriage. With such a construction, manual operation of the nut and screw jack assembly provides relative vertical movement between the inner and outer tubes and in turn relative vertical movement between the carriage and the base thereby raising or lowering the lift element.

6 Claims, 8 Drawing Figures

MANUAL LIFTER AND MOVER ASSEMBLY

BACKGROUND OF THE PRESENT INVENTION

1. Field of the Invention

The manual lifter and mover assembly or dolly of the present invention is used for moving large crates, cabinets, desks and other hard to handle items. A pair of dollies are used with each load. Such material handling equipment can be used in various industrial and institutional environments as is well known in the art.

2. Description of the Prior Art

The prior art illustrates various manual lifter and mover assemblies or dollies designed to handle bulky equipment. Generally such devices utilize a winch or a hydraulic control for raising or lowering the lift element. Such hydraulic jacks leak while the winch units bind and are thus not as efficient and operationally functionable as the mechanical nut and screw jack assembly of the present invention which is easy-to-operate and automatically holds the load at any position and provides positive lowering control of the lift element.

SUMMARY OF THE PRESENT INVENTION

It is a feature of the present invention to provide a manual lifter and mover assembly or dolly comprising a pair of elongated and vertically parallel first and second frame members of generally equal width and which are spaced apart, with one frame member forming a base and the other frame member mounted on the base and forming a vertically movable carriage.

A further feature of the present invention is to provide a manual lifter and mover assembly of the aforementioned type wherein the base includes a pair of laterally spaced apart and parallel channel members of equal length forming tracks which face the carriage. An upper horizontal member is provided connecting the upper ends of the channel members and a lower horizontal member is provided connecting the lower ends of the channel members, with the lower member having a generally horizontal flange. A pair of ground engaging wheels are located beneath the flange and are secured thereto for movably supporting the lifter and mover assembly.

A still further feature of the present invention is to provide a manual lifter and mover assembly of the aforementioned type wherein the carriage has three parallel vertical elements including a pair of outer vertical elements and an intermediate vertical element. A top element is secured to the upper ends of the vertical elements and a lift element is carried by the lower end of the carriage on the front side thereof for engaging and supporting the load. A pair of vertically spaced apart roller assemblies are carried by each of the outer vertical elements and extend into the opposite tracks of the channel members.

Another feature of the present invention is to provide a manual lifter and mover assembly of the aforementioned type wherein an elongated manually operated nut and screw jack assembly is interposed between the base and the carriage and is arranged parallel to the vertical members and elements. The jack assembly has a pair of telescopically arranged inner and outer tubes, with the lower end of the inner tube being secured to the flange of the lower member of the base and the outer tube being secured to the intermediate vertical element of the carriage whereby manual operation of the nut and screw jack assembly provides relative vertical movement between the inner and outer tubes and in turn relative vertical movement between the carriage and the base thereby raising or lowering the lift element.

Still another feature of the present invention is to provide a manual lifter and mover assembly of the aforementioned type wherein the tracks of the channel members each include a pair of parallel track flanges which are spaced apart and are located at the entrance to the channel members. Each roller assembly has a pair of annular grooves which receive the track flanges. The roller assemblies are guided by the track flanges during movement of the roller assemblies in the tracks when the carriage is moved by the nut and screw jack assembly.

A further feature of the present invention is to provide a manual lifter and mover assembly of the aforementioned type wherein a pair of such assemblies are utilized to handle big bulky loads such as large crates, cabinets, desks, and other hard to handle items. In use, one assembly or dolly is placed at one end of the load, the lifting plate or forks are slid underneath the load and thereafter the screw and jack assembly is operated until the load clears the floor. Thereafter, the second assembly or dolly is placed at the other end of the load and the same procedure is followed. Finally, the load may be moved by either pushing or pulling on one of the dollies.

Another feature of the present invention is to provide a manual lifter and mover assembly of the aforementioned type which is simple in construction, efficient in operation, easy to assemble and disassemble and is economical to manufacture and to repair.

DESCRIPTION OF A PREFERRED EMBODIMENT

Figure 1:
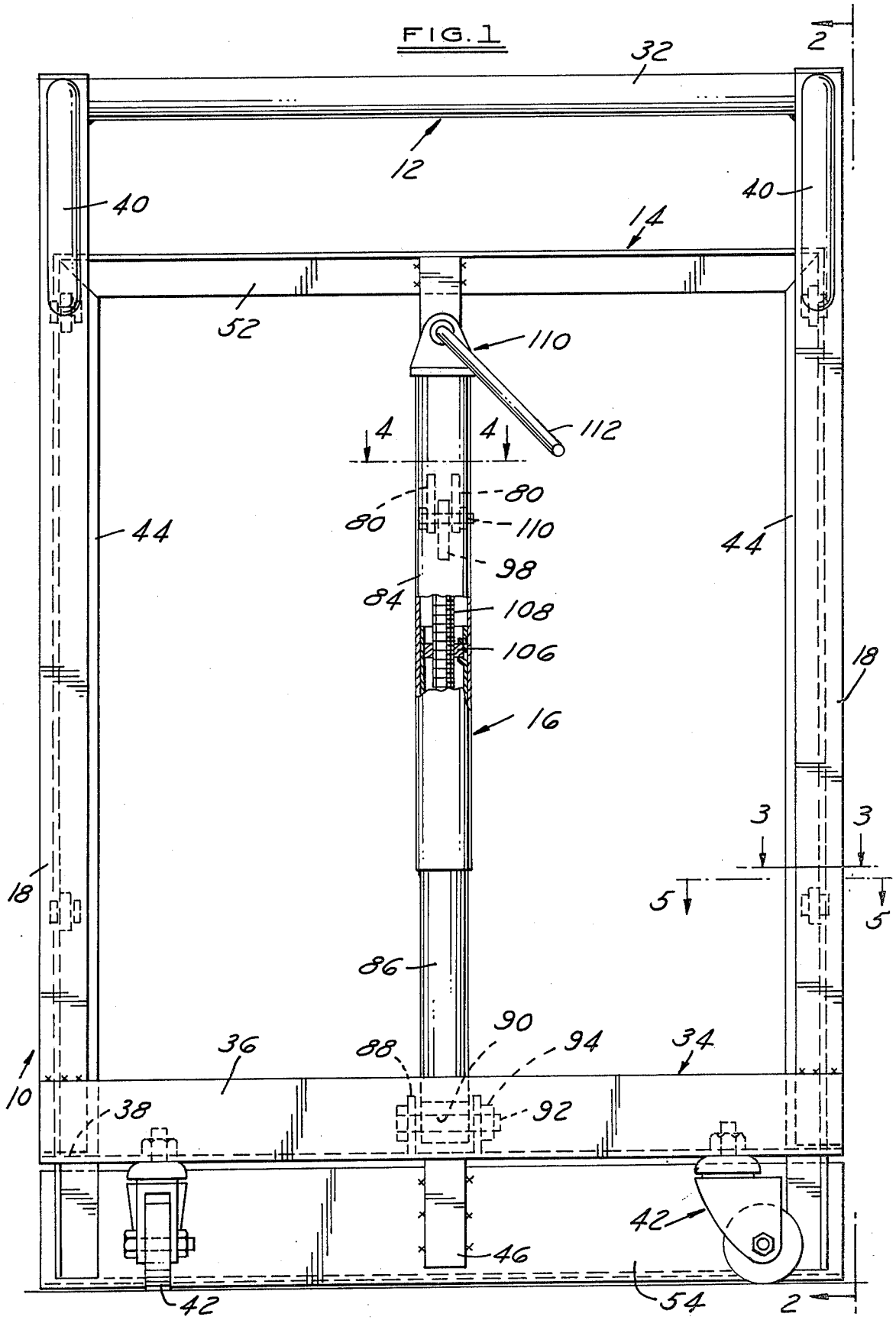
FIG. 1 is a rear elevation of the manual lifter and mover assembly.
Figure 2:
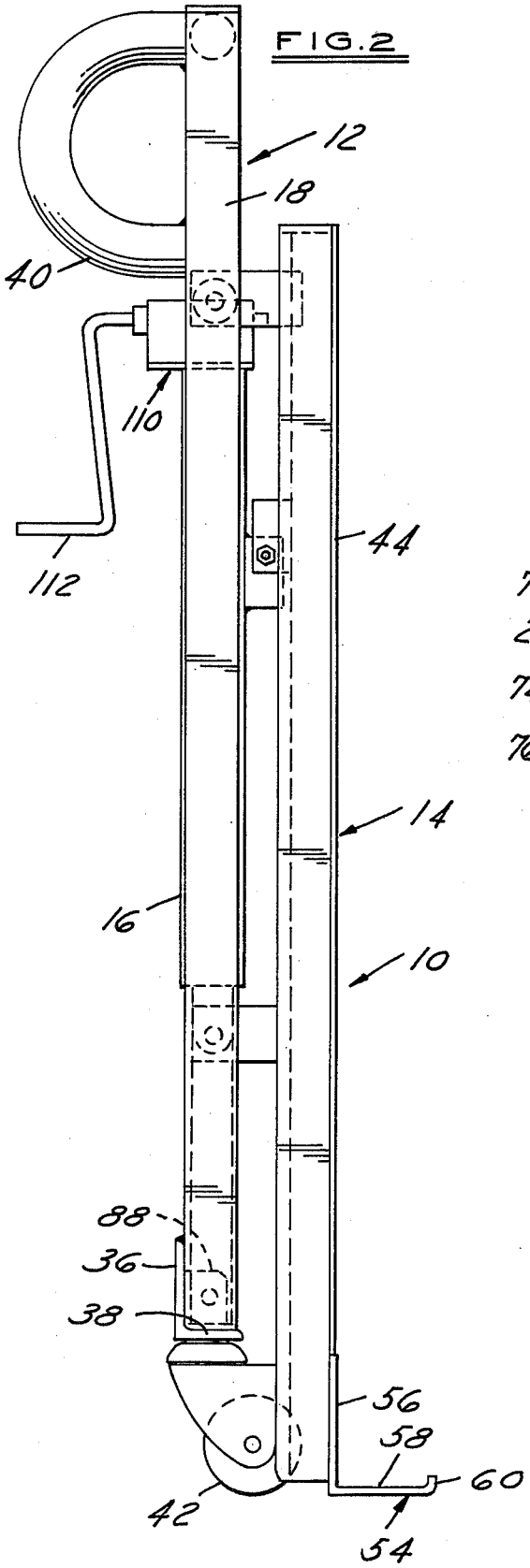
FIG. 2 is a side elevation looking in the direction of arrows 2—2 of FIG. 1.

The manual lifter and mover assembly or dolly is designated by the numeral 10 in FIGS. 1 and 2 and includes three main components including a first frame member or base 12; a second frame member or carriage 14; and an elongated manually operated nut and screw jack assembly 16 interposed between the base 12 and carriage 14. The base 12 and carriage 14 are elongated, parallel and of generally equal width. The base 12 and carriage 14 are spaced apart in side by side relation.

Figure 3:
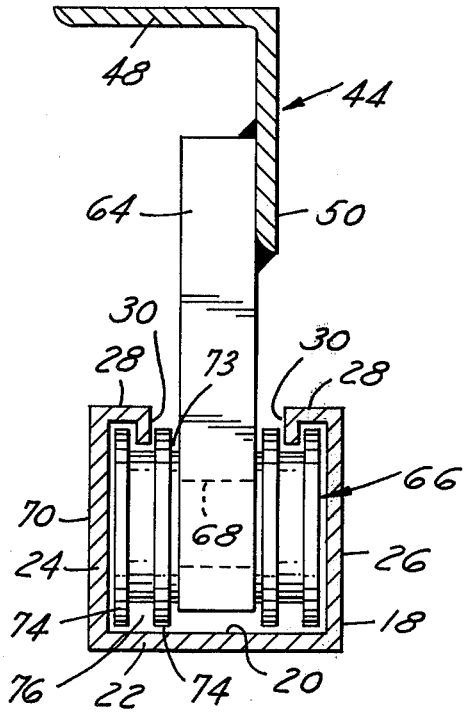
FIG. 3 is a sectional view taken on the line 3—3 of FIG. 1 and illustrating the novel roller and track construction.
Figure 5:
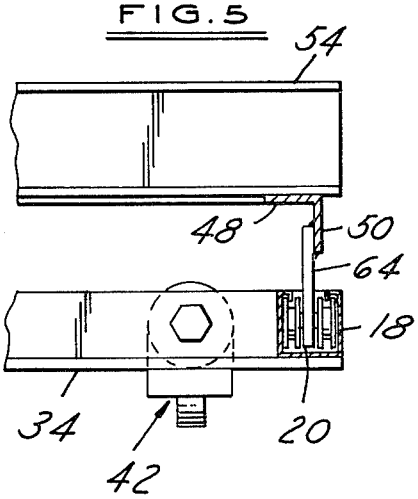
FIG. 5 is a sectional view taken on the line 5—5 of FIG. 1.

The base 12 includes a pair of laterally spaced apart channel members 18 of equal length forming tracks 20 which face the carriage 14. Each track 18 is of channel shape or box shape cross-section as illustrated in FIGS. 3 and 5. Each channel member 18 includes a base portion 22 and a pair of parallel and spaced apart side members 24 and 26, the upper ends of which adjacent the entrance to the track 20 being provided with integral and inwardly turned flanges 28. Such flanges 28 terminate in parallel tracks flanges 30 which extend rearwardly towards the base portion 22 as best illustrated in FIG. 3. The track flanges 30 are parallel and spaced apart and the track 20 is otherwise open to permit the insertion of the roller assemblies to be subsequently described.

The base 12 is further provided with an upper horizontal member 32 of tubular construction which connects the upper ends of the channel members 18 and is also provided with a lower horizontal member 34 connecting the lower ends of the channel members 18. The lower member 34 is an angle having vertical and horizontal flanges 36 and 38 respectively.

Figure 8:
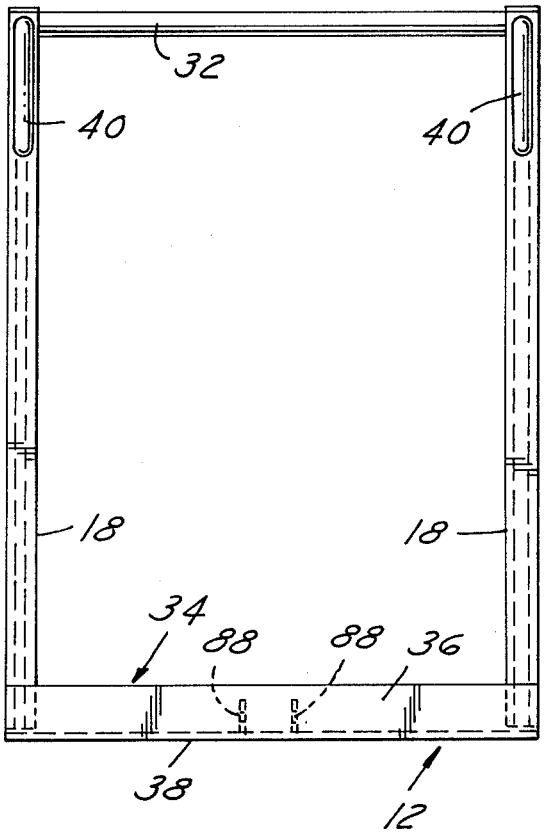
FIG. 8 is a rear elevational view of the base of the lifter and mover assembly.

The upper end portions of the channel members 18 on the back side thereof are provided with a pair of handles 40 which are laterally spaced apart as best illustrated in FIGS. 1 and 8. The handles 40 are of part circular configuration as illustrated in FIG. 2 and the opposing ends of each handle 40 are welded to the channel members 18.

A pair of ground engaging wheels or wheel assemblies 42 of conventional construction are located beneath and are mounted on the horizontal flange 38 of the lower member 34 for movably supporting the lifter and mover assembly 10 as best illustrated in FIGS. 1 and 2. Such wheel assemblies 42 may take the form of swivel type casters or rigid casters as is well known in the art. As shown, the wheel assemblies 42 are swivel type casters. Any reasonable number of casters, rigid or swivel, may be provided on the base 12 although two are recommended.

Figure 6:
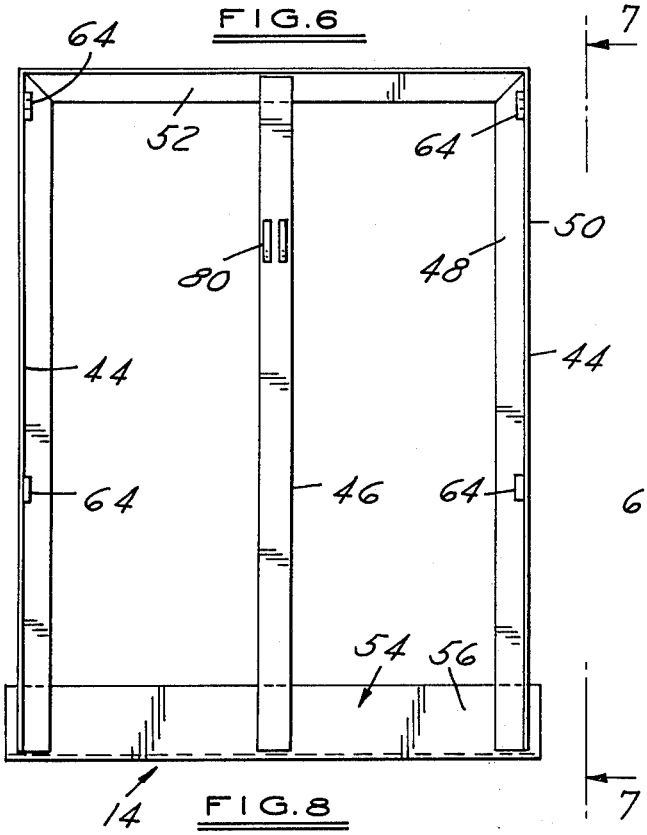
FIG. 6 is a rear elevational view of the carriage.
Figure 7:
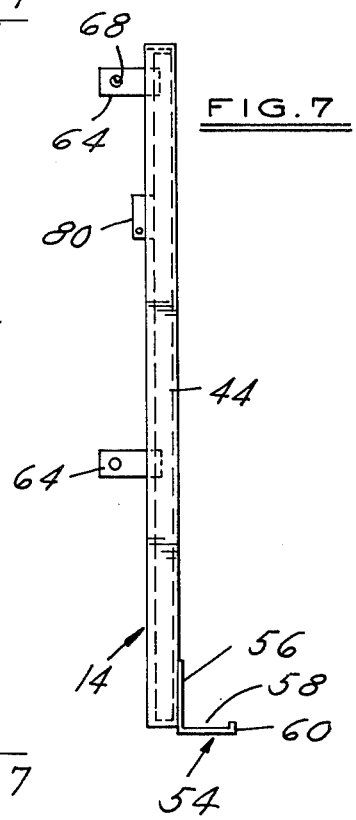
FIG. 7 is a side elevational view of the carriage looking in the direction of the arrows 7—7 of FIG. 6.

The carriage 14, as best illustrated in FIG. 6, has three parallel vertical elements including a pair of outer vertical elements 44 and an intermediate vertical element 46. Each of the vertical elements 44 are of about the same length and are made from an angle having a pair of right angle flanges 48 and 50. A top horizontal element 52 secures the upper ends of the vertical elements 44 while an elongated lift element 54 is secured to the lower ends of the three vertical elements 44, 46 as best illustrated in FIGS. 6 and 7. Such lift element 54 has an upstanding vertical flange 56 and a horizontal flange 58 terminating in an upwardly turned lip 60. Such lift element 54 may be notched at the center to provide clearance for a center support or structural element on the objects to be lifted or a pair of adjustable fork-like elements may be appropriately mounted on a support rod secured to the bottom of the carriage 14 to permit the forks to be movable relative to one another to fit different loads or skid spacings etc. as is well known in the art.

Each of the outer vertical elements 44 of the carriage 14 is provided with a pair of vertically spaced apart lugs 64, the outer ends of which are provided with a roller assembly 66. Each lug 64 is welded to the flange 50 of the vertical element 44 as best illustrated in FIGS. 3 and 5 and is provided with a hole 68 through which a shaft 70 of the roller assembly 66 extends. Each end of shaft 70 is provided with a grooved anti-friction type roller 72 which is mounted and retained on shaft 70 by appropriate fastening means. A thrust washer 73 is located on shaft 70 between each roller 72 and the lug 64. Each roller 72 has a pair of flanges 74 which are spaced apart and surround an annular groove 76. The grooves 76 receive the track flanges 30 as best illustrated in FIG. 3. The carriage 14 as it is moved vertically glides up and down on the generally enclosed low friction steel rollers 72 which move in the tracks 20.

Figure 4:
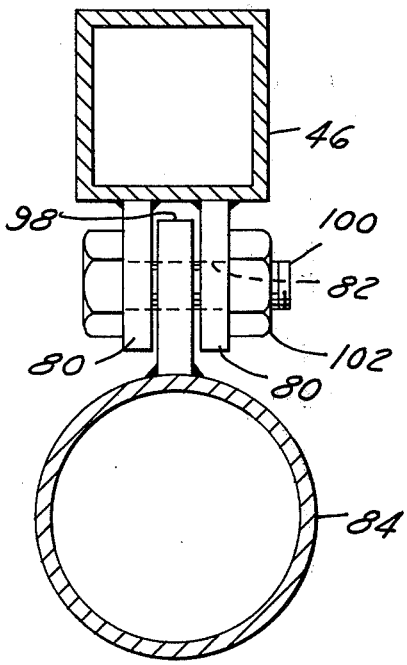
FIG. 4 is a sectional view taken on the line 4—4 of FIG. 1 and illustrating the manner in which the nut and screw jack assembly is connected to the intermediate vertical element of the movable carriage.

The intermediate vertical element 46 is of tubular construction and has a rectangular cross section as best illustrated in FIG. 4. The upper end portion of the tube or intermediate vertical member 46 is provided with a pair of laterally spaced mounting lugs 80, each provided with a bolt opening 82.

The elongated nut and screw jack assembly 16 consists of an outer jack tube 84 and an inner jack tube 86 which are telescopically arranged. The jack assembly 16 is arranged parallel to the vertical members 18 and elements 44, 46. The lower horizontal member 34 of the base 12 is provided with a pair of laterally spaced apart lugs 88. The lugs 88 are provided with bolt openings. The lower end of the inner tube 86 is provided with a bolt opening 90. The inner tube 86 is inserted between the upstanding lugs 88 and thereafter a bolt 92 is inserted through the aligned holes provided in the tube 86 and lugs 88. A nut 94 is placed on bolt 92 as shown in FIG. 1 to secure the inner tube 86 to the lugs 88 mounted on the base 12.

The outer tube 84 is provided with a mounting lug 98 which fits into the space between lugs 80 provided on the carriage tube 46 as shown in FIG. 4. A bolt 100 is inserted through the aligned openings provided in lugs 80 and 98. A nut 102 is provided on bolt 100 and secures the jack assembly 16 to tube 46 in parallel relation.

One form of jack assembly 16 suitable for use is the Atwood Sidewind Jack No. 120-80310 manufactured and sold by the Atwood Mobile Products Division of Atwood Vacuum Machine Co. of Rockford, Illinois.

Such jack assembly 16, as shown in FIG. 1, includes in the interior thereof a stationary internally threaded nut 106 and an elongated screw 108 which is threadedly carried by the nut 106.

The jack assembly 16 includes actuating means 110 operatively connected to the screw 108 for turning same. As an example, a gear, not shown, is carried by the stem located on the upper end of screw 108. The operating handle 112 has a gear, not shown, on its inner end which meshes with the screw gear and turns same thereby raising or lowering the screw.

Manual operation of handle 112 of the nut and screw jack assembly 16 provides relative vertical movement between the inner and outer tubes 84, 86 and in turn relative vertical movement between the carriage 14 and the base 12 thereby raising or lowering the lift element 54.

In use, the operator grips handles 40 and rolls the assembly 10 to one end of the load. The operator slides the lift plate 54 or forks underneath the load and pushes the assembly 10 against the load. The operator holds the assembly 10 in place with one hand while using the other hand to crank or operate handle 112 thus elevating screw 108 and lifting plate 54 until it contacts the load. Cranking is continued until the load is clear of the floor. The same procedure is followed with the second assembly 10 used on the opposite end of the load. Thereafter the loaded assemblies 10 may be moved by either pushing or pulling.

The nut and screw jack assembly 16 has approximately thirteen inches of travel. Thus lift plate 54 or forks can be raised thirteen inches. The manually operated nut and screw jack assembly 16 in combination with the roller and track system provide fast and convenient means for lifting and moving heavy loads.

In FIG. 2 the upwardly turned up lip 60 has multiple purposes. The weight of the lifted object, concentrated on the top edge of the upturned lip 60, causes the lip 60 to cut into the lifted object thereby resisting a tendency for the lifted object to slip off. The upwardly turned up lip 60 also concentrates the weight of the lifted object some distance from the axle of wheels 42 thereby creating a moment. The moment is resisted by pressure between the upper part of the carriage 14 and the lifted object. Such structure is necessary to keep the lifted object from slipping off of the manual lifter and mover assembly 10. The adjustable forks, when used, function in a like manner.

What is claimed is:

1. A manual lifter and mover assembly comprising a pair of elongated and vertically parallel first and second frame members of generally equal width and which are spaced apart, one frame member forming a base and the other frame member forming a vertically movable carriage, said base including a pair of laterally spaced apart parallel channel members of equal length forming tracks which face said carriage, an upper horizontal member connecting the upper ends of said channel members and a lower horizontal member connecting the lower ends of said channel members, said lower member having a generally horizontal flange, a pair of ground engaging wheels located beneath said flange and secured thereto for movably supporting said lifter and mover assembly, said carriage having three parallel vertical elements including a pair of outer vertical elements and an intermediate vertical element, a top horizontal element secured to the upper ends of said vertical elements and a lift element carried by the lower end of said carriage on the front side thereof for engaging and supporting the load, a pair of vertically spaced apart roller assemblies carried by each of the outer vertical elements, said roller assemblies extending into the opposite tracks of said channel members, an elongated manually operated nut and screw jack assembly interposed between said base and said carriage, said nut and screw jack assembly being arranged parallel to said vertical members and elements and having a pair of telescopically arranged inner and outer tubes, said jack assembly having the lower end of said inner tube secured to said flange of the lower member of said base and said outer tube secured to said intermediate vertical element of said carriage whereby manual operation of said nut and screw jack assembly provides relative vertical movement between said inner and outer tubes and in turn relative vertical movement between said carriage and said base thereby raising or lowering said lift element, the tracks of said channel members each including a pair of parallel track flanges which are spaced apart and are located at the entrance to the channel member, each roller assembly having a pair of annular grooves which receive said track flanges, said roller assemblies being guided by said track flanges during movement of said roller assemblies in said tracks when said carriage is moved by said nut and screw jack assembly.

2. The manual lifter and mover assembly defined in claim 1 wherein said intermediate vertical element is of tubular construction and is located midway between said outer vertical elements.

3. The manual lifter and mover assembly defined in claim 2 wherein said tubular intermediate vertical element is of rectangular cross-section.

4. The manual lifter and mover assembly defined in claim 1 wherein a pair of handles are secured to the upper end portions of said channel members on the back side thereof for assisting the operator in moving the assembly.

5. The manual lifter and mover assembly defined in claim 4 wherein said handles are of curved configuration.

6. The manual lifter and mover assembly defined in claim 1 wherein said lift element has an outer edge provided with an upwardly turned lip which is parallel to and spaced from the vertical elements of said carriage.

* * * * *